United States Patent [19]

Wohlfeil

[11] 4,282,826

[45] Aug. 11, 1981

[54] APPARATUS FOR REGULATION OF THE COATING THICKNESS IN THE COATING OF CONTINUOUS WEBS OF MATERIAL

[75] Inventor: Gerhard Wohlfeil, Monheim, Fed. Rep. of Germany

[73] Assignee: Jagenberg-Werke AG, Dusseldorf, Fed. Rep. of Germany

[21] Appl. No.: 96,357

[22] Filed: Nov. 21, 1979

[30] Foreign Application Priority Data

Nov. 24, 1978 [DE] Fed. Rep. of Germany ..... 2851015

[51] Int. Cl.[3] ..... B05C 11/02

[52] U.S. Cl. ..... 118/118; 15/256.5

[58] Field of Search ..... 118/118, 119, 110, 262, 118/123, 126; 15/256.52, 256.5; 427/361

[56] References Cited

U.S. PATENT DOCUMENTS

| | | | |
|---|---|---|---|
| 3,029,779 | 4/1962 | Hornbostel | 118/119 X |
| 3,450,098 | 6/1969 | Williams, Jr. | 118/126 |
| 3,683,851 | 8/1972 | Nolden | 118/126 |
| 3,701,335 | 10/1972 | Barnscheidt | 118/119 |
| 3,817,208 | 6/1974 | Barnscheidt et al. | 118/119 |

FOREIGN PATENT DOCUMENTS

| | | | |
|---|---|---|---|
| 2307404 | 8/1974 | Fed. Rep. of Germany | 118/126 |

*Primary Examiner*—John P. McIntosh

*Attorney, Agent, or Firm*—Sprung, Felfe, Horn, Lynch & Kramer

[57] ABSTRACT

An apparatus for the regulation of the coating thickness in the coating of continuous webs of material has a doctor-roll which bears on the coated side of the web and which is supported in a shape-retaining, wear-resistant doctor-roll bed. The doctor-roll bed is elastically joined to a stationary frame of the apparatus in such a manner that it is removably mounted for replacement independent of the remainder of the elastic joint.

12 Claims, 5 Drawing Figures

APPARATUS FOR REGULATION OF THE COATING THICKNESS IN THE COATING OF CONTINUOUS WEBS OF MATERIAL

BACKGROUND OF THE INVENTION

The invention relates to an apparatus for regulation of the coating thickness in the coating of continuous webs of material by means of a doctor roll which bears on the coated side of the web and is supported in a shape-retaining, wear-resistant doctor-roll bed that is joined to the machine frame through an elastic mount.

Such an apparatus is known from German patent application DOS No. 20 08 082, for example. In that prior-art apparatus the doctor-roll bed is rigidly joined to the mount, and the two must be replaced as a unit.

In the apparatus according to German Pat. No. 21 50 907, too, the doctor-roll bed and its mount cannot be separated from each other since the mount, made of a rubberlike material, is integral with the doctor-roll bed.

SUMMARY OF THE INVENTION

It is the object of the invention to provide an apparatus of the type outlined which permits the doctor-roll bed, a part subject to wear, to be replaced along with the doctor roll without the mount having to be replaced.

In accordance with the invention, this object is accomplished by joining the doctor-roll bed to the elastic mount in such a way that the doctor-roll bed can readily be replaced.

The doctor-roll bed is advantageously a sliding fit in a substantially parallel-walled groove of the mount.

In accordance with a further characteristic of the invention, an air hose is provided between the doctor-roll bed and the bottom of the substantially parallel-walled groove of the mount. This air hose, not novel in itself, serves to enhance or in fact provide the elasticity of the mount. In this embodiment of the invention, the mount is constructed of an aluminum section.

Moreover, the mount is advantageously supported in the area of the doctor-roll bed by a rigid thrust bar in line contact therewith. The latter may be adjustable in the machine frame along the line of contact by means of push-pull set screws.

The mount is advantageously joined to the machine frame through a clamping beam and is adapted to be replaced along with the doctor-roll bed by an elastic doctor blade. Mount, doctor-roll bed and doctor roll can then be simply replaced as a unit with an elastic doctor blade when the need arises.

The doctor-roll bed is advantageously constructed, in a manner not novel in itself, of a material having the elasticity of rubber.

In another embodiment of the invention, the mount is provided with a groove with walls converging toward the open top of the groove in which the doctor-roll bed made of a rubberlike material is disposed. The doctor-roll bed with the doctor roll is adapted to be slipped out of the mount along its longitudinal axis. The mount may be made of a rubberlike material having a lesser Shore hardness than the doctor-roll bed. The mount then has the requisite elasticity while the doctor-roll bed possesses the necessary high wear resistance and shape retention.

Alternatively, the mount may also be made of spring sheet.

In accordance with an advantageous characteristic of the invention, the mount is of two-part construction. The two parts are advantageously held together by the clamping beam in which the mount is seated.

BRIEF DESCRIPTION OF THE DRAWINGS

The invention will now be described in greater detail with reference to embodiments illustrated in the accompanying drawings, wherein.

DETAILED DESCRIPTION OF THE INVENTION

Figure 1:
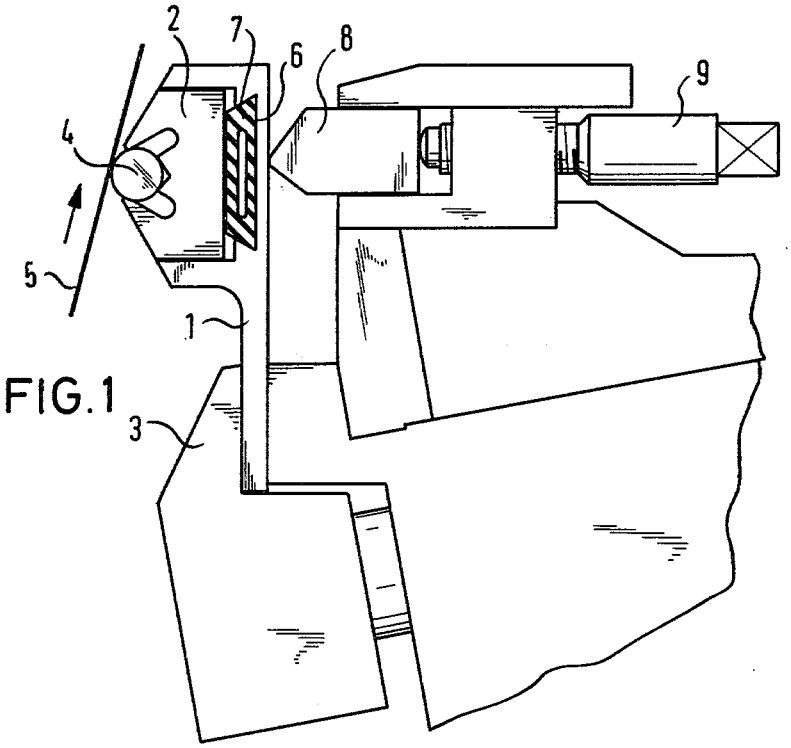
FIG. 1 is a diagrammatic representation of the apparatus in accordance with the invention with a mount held in a clamping beam along with the doctor-roll bed, which is a sliding fit in a substantially parallel-walled groove of the mount.

In the apparatus illustrated in FIG. 1, a mount 1 for a doctor-roll bed 2 is clamped in a clamping beam 3 on the machine frame. The doctor-roll bed 2, made of a material such as Vulkolan having the elasticity of rubber, is a sliding fit in a parallel-walled groove of the mount 1 fabricated from an aluminum section. The doctor-roll bed 2 holds a doctor roll 4 which bears on a coated web of material moving in the direction indicated by the arrow in FIG. 1.

Disposed between the doctor-roll bed 2 and the bottom 6 of the substantially parallel-walled groove of the mount 1 is an air hose 7, not novel in itself, which enhances or actually provides the elasticity of the mount 1. The hose 7 has outwardly converging side walls which are matingly received in a groove in the bottom 6 of the parallel walled groove of mount 1. The hose is removable by longitudinally sliding it out of the mount 1.

In the area of the doctor-roll bed 2 the mount 1 is supported on its back by a rigid thrust bar 8 which is in line contact therewith. The thrust bar 8 is adjustable relative to the clamping beam 3 or the machine frame by means of push-pull set screws 9. The entire mount 1 with inserted doctor-roll bed 2 is adapted to be removed from the clamping beam 3 after the clamping pressure has been released, and to be replaced with an elastic doctor blade, which then is likewise supported by the thrust bar 8. A displacement of the clamping beam 3 relative to the thrust bar 8 then results in a change in the contact pressure of the elastic doctor blade.

Figure 2:
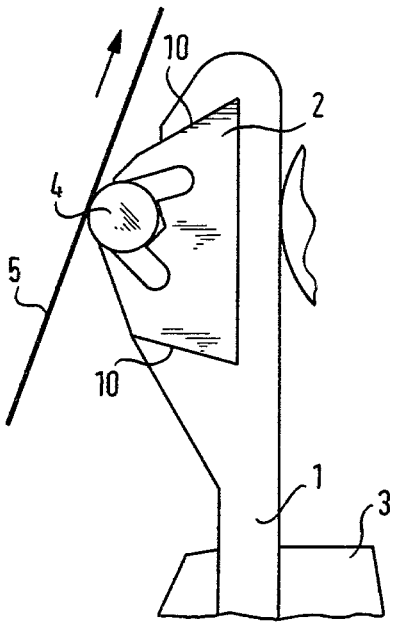
FIG. 2 shows another embodiment of the mount, made of a rubberlike material and provided with a groove with walls converging toward the open top of the groove in which the doctor-roll bed is seated.

FIG. 2 shows a mount 1 of a rubberlike material which is provided with a groove having walls 10 which converge toward the open top of the groove. Seated in this groove is the doctor-roll bed 2, which has appropriately shaped sides. The doctor-roll bed 2 is adapted to be slipped out of the mount 1 along its longitudinal axis.

Figure 3:
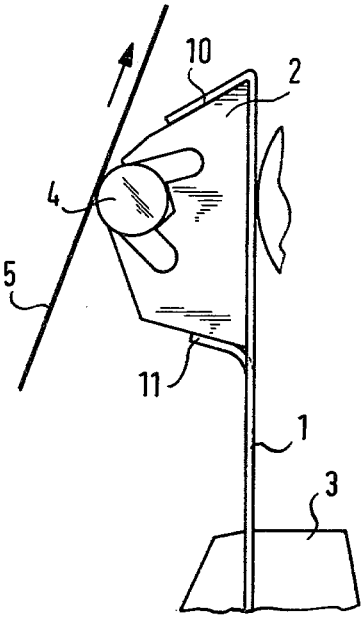
FIG. 3 shows an embodiment of a mount that is similar to the one illustrated in FIG. 2 but is made of spring sheet.

Shown in FIG. 3 is a mount 1 made of spring sheet and having a groove corresponding to that of the mount 1 according to FIG. 2. The inclined wall of the groove on the side facing the clamping beam 3 is formed by lugs 11 stamped out of the spring sheet from which the mount 1 is fabricated. The doctor-roll bed 2 is again slidable in the longitudinal direction relative to the mount 1.

Figure 4:
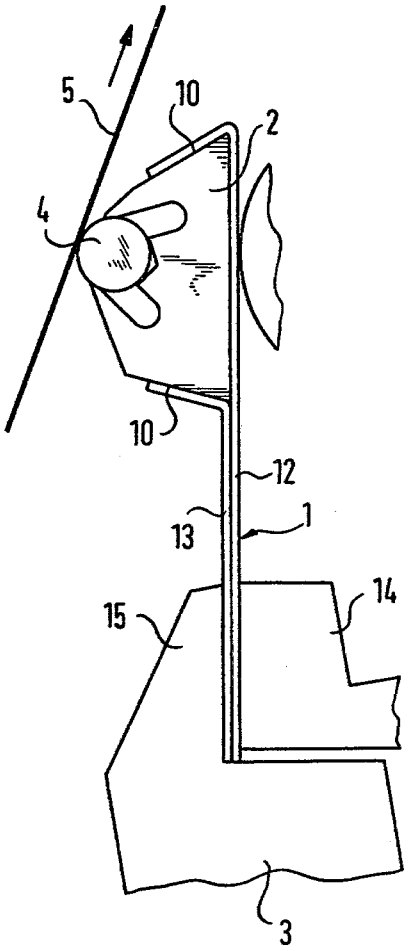
FIG. 4 shows an embodiment of a mount which is similar to that of FIG. 3 but is of two-part construction, and is in the clamped condition.
Figure 5:
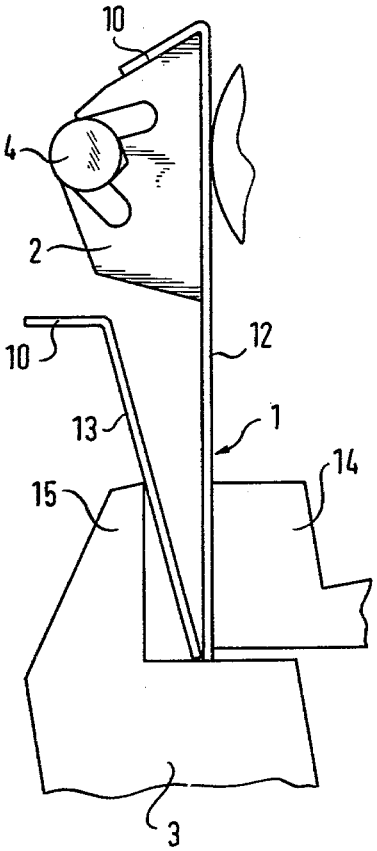
FIG. 5 shows the mount according to FIG. 4 with the clamping jaws open.

FIGS. 4 and 5 show an embodiment of a mount 1 which is of two-part construction. In FIG. 4, the two parts 12 and 13 of the mount 1 are shown clamped together by means of the clamping beam 3, with the apparatus as a whole ready for operation. FIG. 5 shows the mount in the open condition in the clamping beam 3 after the clamping force has been released. In that position, the doctor-roll bed 2 can be replaced together with the doctor roll with the greatest ease.

In the closed position, the jaws 14 and 15 of the clamping beam 3 hold the two parts 12 and 13 of the mount 1 firmly together and assure secure seating of the doctor-roll bed 2.

It will be appreciated that the instant specification and claims are set forth by way of illustration and not limitation, and that various changes and modifications may be made without departing from the spirit and scope of the present invention.

What is claimed is:

1. In an apparatus for the regulation of the coating thickness in the coating of continuous webs of material having a doctor roll which bears on the coated side of the web and which is supported in a shape-retaining, wear-resistant doctor-roll bed and means elastically joining the doctor-roll bed to a stationary frame, the improvement wherein the elastic joining means comprises an elastically deformable mount and means removably mounting the doctor roll bed in the mount for replacement of the doctor-roll bed independent of the mount and biasing means for deforming the mount to move the doctor-roll into contact with a web.

2. An apparatus according to claim 1, wherein the removable mounting means comprises the elastic mount having a substantially parallel-walled groove and wherein the doctor-roll bed is configured to slidably fit in the groove.

3. An apparatus according to claim 2, wherein the removable mounting means further comprises an air hose disposed between the doctor-roll bed and the bottom of the substantially parallel-walled groove of the mount.

4. An apparatus according to claim 2 or 3, wherein the mount comprises an aluminum section.

5. An apparatus according to claim 2, wherein the biasing means comprises a rigid thrust bar supporting the mount in the area of the doctor-roll bed and in line contact with the mount.

6. An apparatus according to claim 5, wherein the biasing means further comprises means mounting the rigid thrust bar for adjustable movement relative to the frame along the line of contact comprising push-pull set screws.

7. An apparatus according to claim 1, wherein the mount comprises a releasable clamping beam for effecting the removable mounting of the doctor-roll bed along with the doctor blade.

8. An apparatus according to claim 1, wherein the doctor-roll bed comprises a material having the elasticity of rubber.

9. An apparatus according to claim 1, wherein the mount has a groove with walls converging toward the open top of the groove in which the doctor-roll bed made of a rubber-like material is seated.

10. An apparatus according to claim 9, wherein the mount is made of a rubberlike material having a lesser Shore hardness than the doctor-roll bed.

11. An apparatus according to claim 9, wherein the mount is fabricated from spring sheet.

12. An apparatus according to claim 11, wherein the mount is of two-part construction.

* * * * *